US007384404B2

(12) United States Patent
Cagle et al.

(10) Patent No.: US 7,384,404 B2
(45) Date of Patent: Jun. 10, 2008

(54) APPARATUS AND METHOD FOR TREATING CELLULITE

(76) Inventors: Merry Cagle, 9356 Grandview Dr., Winston, GA (US) 30187; Quentin Ulz, 1880 N. Creek Cir., Alpharetta, GA (US) 30004

( * ) Notice: Subject to any disclaimer, the term of this patent is extended or adjusted under 35 U.S.C. 154(b) by 0 days.

(21) Appl. No.: 11/744,501

(22) Filed: May 4, 2007

(65) Prior Publication Data

US 2007/0260159 A1 Nov. 8, 2007

Related U.S. Application Data

(63) Continuation-in-part of application No. 11/267,592, filed on Nov. 4, 2005, now abandoned.

(60) Provisional application No. 60/625,458, filed on Nov. 5, 2004.

(51) Int. Cl.
*A61H 7/00* (2006.01)

(52) U.S. Cl. ..... 601/6; 601/9

(58) Field of Classification Search ..... 601/6–9, 601/122, 125, 126, 133, 134
See application file for complete search history.

(56) References Cited

U.S. PATENT DOCUMENTS

| | | | | |
|---|---|---|---|---|
| 2,519,790 | A * | 8/1950 | Quinn | 601/6 |
| 4,086,922 | A * | 5/1978 | Henderson | 601/19 |
| 6,464,653 | B1 * | 10/2002 | Hovland et al. | 601/7 |
| 6,517,499 | B1 * | 2/2003 | Pereira | 601/7 |
| 2005/0159685 | A1 * | 7/2005 | Klein et al. | 601/49 |

* cited by examiner

*Primary Examiner*—Michael A. Brown
(74) *Attorney, Agent, or Firm*—Smith, Gambrell & Russell

(57) ABSTRACT

A system and apparatus for treating cellulite that includes a housing having a first opening for communication with a vacuum source and a second opening in communication with the first opening for delivering negative pressure or modulated negative pressure from the vacuum source to the body at a predetermined operational level. The second opening is located adjacent a bottom portion of the housing and a plurality of roller balls are disposed around the second opening for delivering massage treatment. Because the roller balls are permitted to rotate freely and smoothly, the housing may be moved across the skin in any direction for delivering massage treatment and negative pressure to the body for treating cellulite.

9 Claims, 10 Drawing Sheets

APPARATUS AND METHOD FOR TREATING CELLULITE

RELATED APPLICATION

This application is a continuation in part of U.S. non-provisional application Ser. No. 11/267,592 filed Nov. 4, 2005 now abandoned. This application also claims the benefit of priority of U.S. provisional application Ser. No. 60/625,458, filed Nov. 5, 2004, which is relied on and incorporated herein by reference.

FIELD OF THE INVENTION

The present invention relates generally to an improved apparatus and system for massaging the human body. In particular, the present invention relates to a portable system and hand-held apparatus for delivering massage treatment and negative pressure to the body in order to treat cellulite.

BACKGROUND OF THE INVENTION

It has been well known for centuries that massage therapy may be used to treat the human body for remedial or hygienic purposes. Massage therapy is highly beneficial because it relaxes and stretches tight muscles, improves circulation, increases range of motion, frees trapped nerves, and relieves muscle spasm. It is also known that more effective results can be secured if the area being massaged is placed under a vacuum or partial vacuum, as this tends to increase the circulation still further in the area being treated. Such a combination of massage treatment and negative pressure has been particularly used in the treatment of cellulite, a fatty deposit typically found around the thighs and buttocks which causes the skin to have a dimpled or uneven appearance.

Accordingly, various types of devices have been proposed to deliver massage treatment and negative pressure to the body for treating cellulite. Such devices typically include a housing in connection with a vacuum source. The vacuum source lifts the skin into the housing where it is kneaded by various kinds of rollers. The rollers are usually cylindrical in shape and may be motorized or mechanically activated to squeeze the skin between the rollers. Such equipment is generally expensive, allows for only limited movement across the skin, and in many cases requires assistance from another, such as a professional, to manipulate the device and deliver the treatment.

A need therefore exists for an improved apparatus and system for treating cellulite that overcomes the shortcomings found in the prior art.

SUMMARY OF THE INVENTION

The present invention answers this need by providing a portable system that includes a hand-held, easy to manipulate apparatus that is suitable for an individual to use on his or her own body, and which may be moved across the skin in any direction for delivering massage treatment and negative pressure to the skin for treating cellulite.

In one embodiment, the cellulite treatment system of the present invention includes a portable container and a housing sized to fit within the portable container for storage and ease of transportation. A vacuum source is located inside the portable container. The housing includes a first opening for communication with the vacuum source and a second opening in communication with the first opening for delivering negative pressure from the vacuum source to the body. The second opening is located adjacent a bottom portion of the housing and a plurality of freely rotatable roller balls are disposed around the second opening for delivering massage treatment.

In operation, the user grasps the housing, presses the bottom portion of the housing against the body, and moves the housing across the skin to provide massage treatment and negative pressure to the skin. The negative pressure provided by the vacuum source pulls the skin into the second opening of the housing. As the housing is moved across the skin, the skin is massaged by the roller balls. Because the roller balls are freely rotatable, the housing may be moved across the skin in any direction for delivering massage treatment and negative pressure to the body for treating cellulite.

In one embodiment, the plurality of roller balls are mounted in cavities adjacent the bottom portion of the housing.

In another embodiment, the present invention further includes a motor located within the housing for subjecting the housing to mechanical vibration to facilitate in the delivery of massage treatment.

In another embodiment the cellulite treatment system includes an attachment that allows a user to connect to an available source of air flow such as a household vacuum cleaner to provide the required vacuum to the hand held component of the invention.

In still another embodiment, the present invention further includes a sensor integrated into the housing for monitoring movement of the housing across the skin. Accordingly, if the sensor detects a lack of or insufficient movement of the housing, an indication may be provided to prompt the user to resume movement of the housing to prevent bruising or marking. Such an indication may include substantially reducing or shutting off the air flow from the vacuum source or activating an alarm.

Therefore, it is an object of the present invention to provide a portable system and apparatus for individual use that may be easily manipulated in any direction across the skin to safely deliver massage treatment and negative pressure to the body for treating cellulite.

Further objects, features and advantages will become apparent upon consideration of the following detailed description of the invention when taken in conjunction with the drawing and the appended claims.

DETAILED DESCRIPTION OF THE INVENTION

Figure 1:
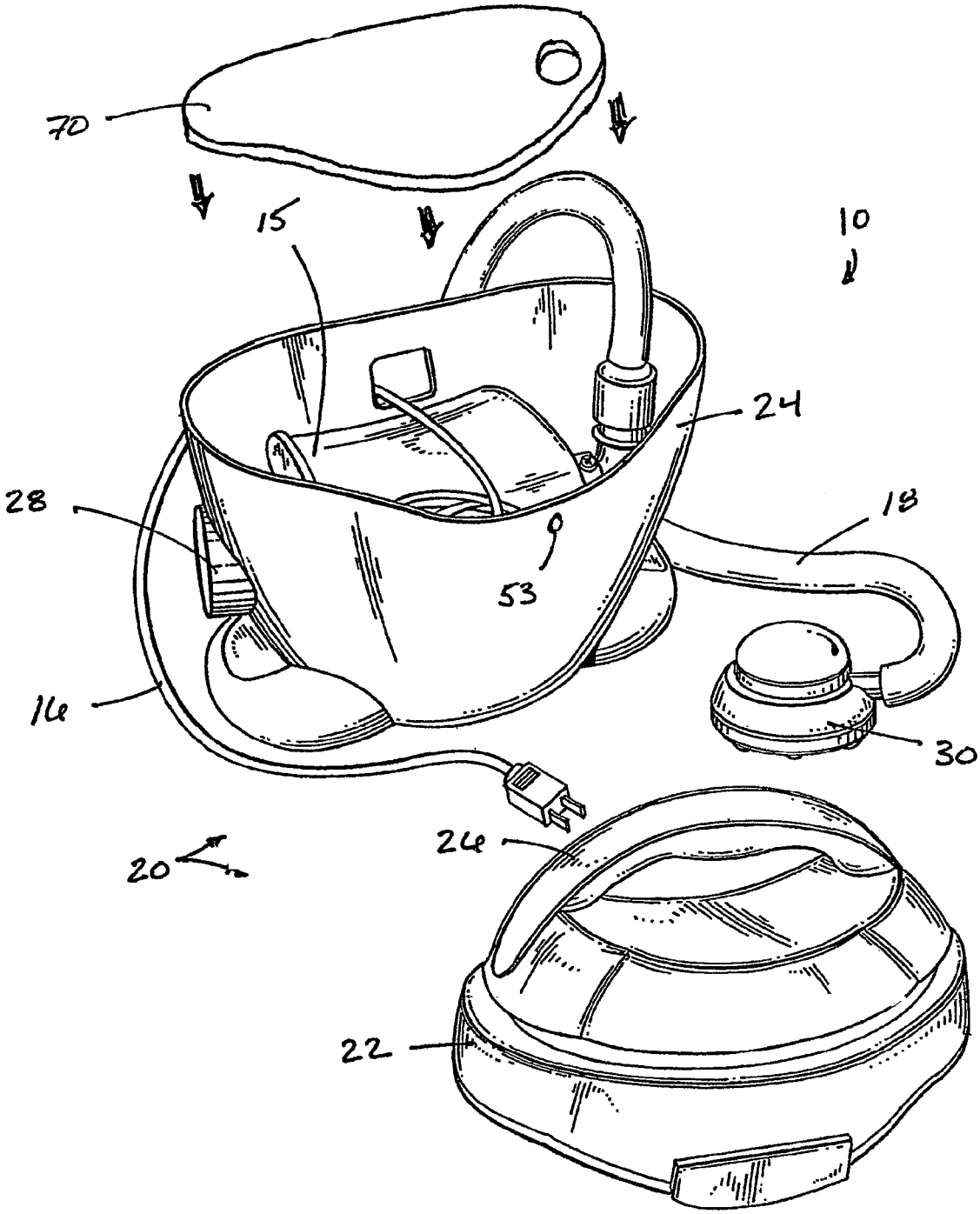
FIG. 1 is a perspective view of the portable container (with cover detached) and the housing in an embodiment of the present invention.

With reference to FIG. 1, a cellulite treatment system 10 in accordance with the present invention is illustrated. The cellulite treatment system 10 comprises a portable container 20 and a housing 30. The portable container includes a cover 22 and a base 24. The cover 22 may be detachably connected or pivot ably connected to the base 24 so that the cover 22 may be detached as shown in FIG. 1 or flipped open (not shown) for access to the contents of the portable container 20. The housing 30 is adapted to be connected to a vacuum source 15 located within the portable container 20 via a flexible hose 18. The vacuum source 15 may be connected to a power source (not shown) via a power cord 16. An exhaust port 28 may be provided on the base 24 of the portable container 20 to permit emissions from the vacuum source 15 to exit the portable container 20.

In other embodiments, the housing 30 may be connected to, and used with, an external vacuum source, rather than the vacuum source 15 located in the portable container 20. It will be appreciated that the vacuum source 15 and/or the external vacuum source may be any suitable source of negative pressure, such as a vacuum cleaner, and may deliver negative pressure of variable or adjustable intensity or may deliver negative pressure that is pulsating in intensity.

Figure 2:
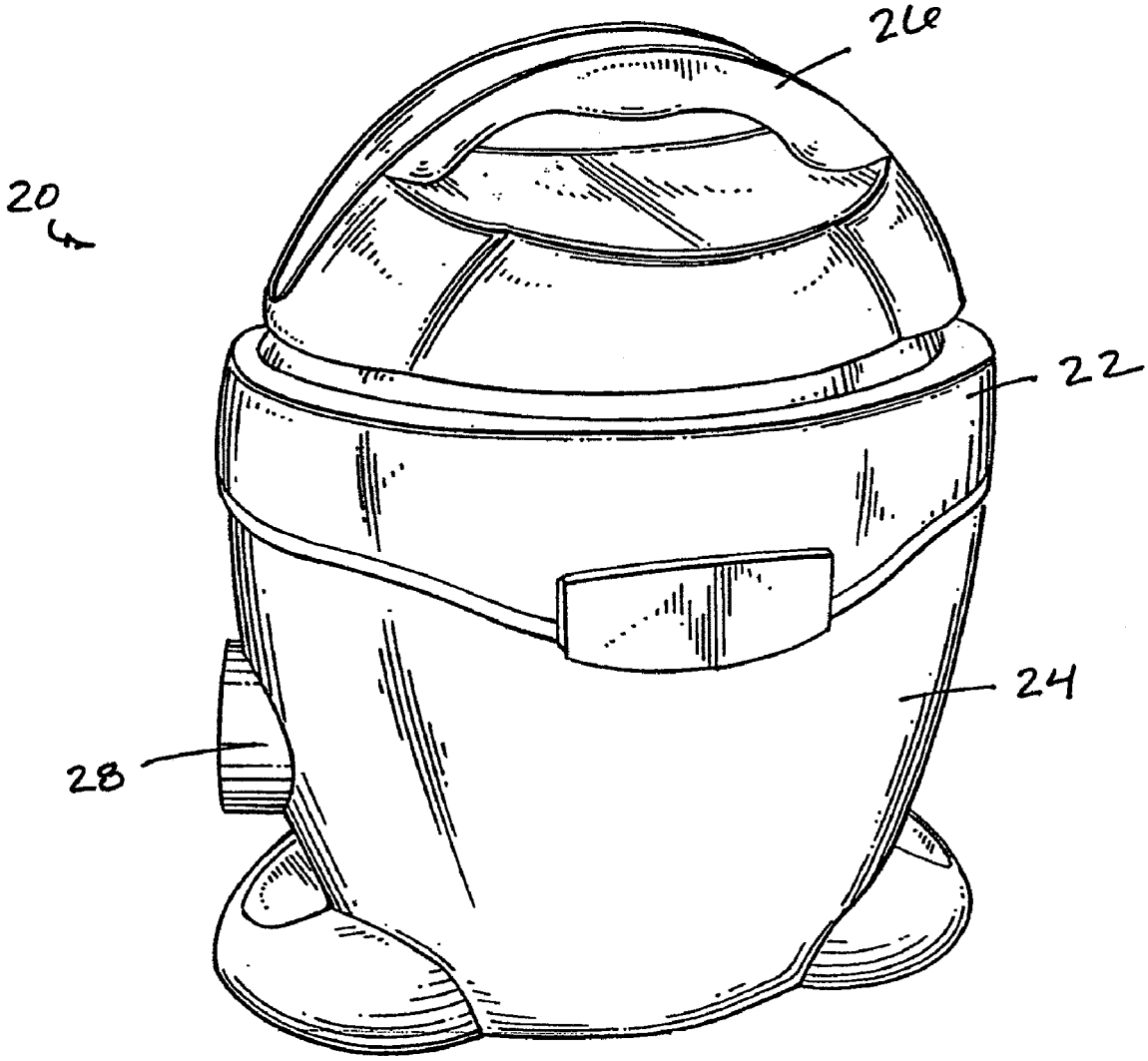
FIG. 2 is a front perspective view of the portable container (with cover attached) in an embodiment of the present invention.

The housing 30 is sized to fit within the portable container 20 for storage and ease of transportation. Accordingly, an individual may conveniently carry the cellulite treatment system 10 by placing the housing 30, hose 18, and power cord 16 inside the base 24 of the portable container 20, attaching or closing the cover 22 of the portable container 20 as shown in FIG. 2, and lifting the container 20 via a handle 26, strap, or the like provided on the portable container 20, such as on the cover 22. A shelf 70 (FIG. 1) may be provided for placing inside the portable container 20 and above the vacuum source 15 to hold the housing 30 and hose 18.

FIGS. 6 to 11 show an alternative embodiment which allows the user to use an alternative vacuum source. In each of these figures I show an adaptor to be used to connect the housing 30 to a vacuum source other than source 15 located in container 20. Of course the vacuum generated by a secondary source, such as a household vacuum cleaner shown as 75, may be excessive therefore the adapter is a vacuum pulse regulator or modulator 77. Modulator 77 is a safety device to regulate or limit the source vacuum so as to reduce the pressure differential to a negative pressure differential determined to be effective for cellulite treatment and safe for the application of the device. Further, modulator 77 is a regulating device intended to produce a controlled pulse of on/off high/low pressure differential that stimulates blood flow and cellulite tissue expansion or smoothing.

Modulator 77 includes a body 79, which is the main molded plastic or metal shell intended to be a air flow channel and framework for attaching housing 30 to modulator 77 via appropriate flexible hose 81 of some length. Body 79 has a tapered tube 89 on the air entry side and a keyed bayonet type fitting 91 to facilitate connection of vacuum cleaner 75 to modulator 77. The fitting is preferentially sized to allow only specific 1¼" or other hose connections to modulator 77 such that the use of over powered home vacuum cleaners will be avoided. Of course other adapters of different configurations are contemplated based on the availability of different vacuum sources.

Within body 79, a molded plastic or metal rotor 93 is mounted on a center axle 95 and connected thereto by a center hub 97. Structural vanes 99 connect hub 97 to a peripheral annulus 101. The rotor is intended to spin due to air movement through the body 79. Annulus 101 has one or more apertures 103 formed there through. Mounted within body 79 adjacent rotor 93 is a fixed constriction baffle 104 having a center journal 105 into which axle 97 is mounted. About journal 105 is an annulus of pie shaped windows 107 which provide constant fluid communication to the vanes 99. Between windows 107 and body 79, constriction baffle 104 is substantially solid having one or more holes 109 there through which are radially spaced for cooperative intermittent alignment with rotor apertures 103. The spinning motion of the rotor thus induces a increase and decrease in the cross sectional area available for air flow through the body 79 resulting in a commensurate pulsation of differential air pressure which can be felt at housing 30.

A safety baffle 111 is mounted within body 79 up stream of constriction baffle 104 with a wedge shaped opening therein defined by a valve seat 113. A reed valve 115 molded from plastic or spring metal acts as a safety valve to close of the airflow through baffle 111 when the differential pressure exceeds the operational differential pressure set for the apparatus. Ostensibly, reed "valve 115 incorporates a movable gate 117 flexibly mounted to baffle 111 in normally open position. The valve has an inherent spring stiffness which is designed to cause the reed valve gate 117 to close against the mating seat 113 when the differential pressure is excessive. Reduction in differential pressure allows the reed valve to open and air to flow through body 79.

Intermediate safety baffle 111 and constriction baffle 104, body 79 has formed therein at least one pressure relief opening 119. The shape of the opening is not important, however the area of the opening or openings must be variable to allow a variable throat size upstream of the constriction baffle. The differential pressure across safety baffle and its reed valve can be varied by varying the degree of obstruction of pressure relief opening 119. In the illustrated embodiment the variation in obstruction is accomplished by a dial type adjustment knob 121 having openings 123 there through which can be variably aligned with pressure relief opening 119. It should be understood that modulator 77 may be incorporated into an embodiment including a self contained vacuum source simply by incorporating the modulator assembly into a hose between the vacuum source 15 and housing 30.

Figure 3:
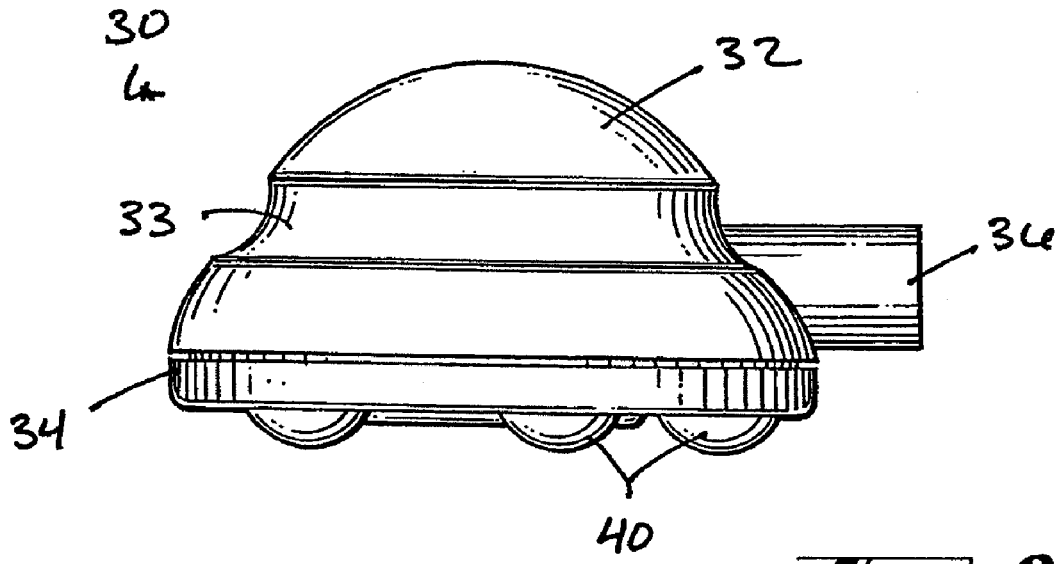
FIG. 3 is a side elevation view of the housing in an embodiment of the present invention.
Figure 4:
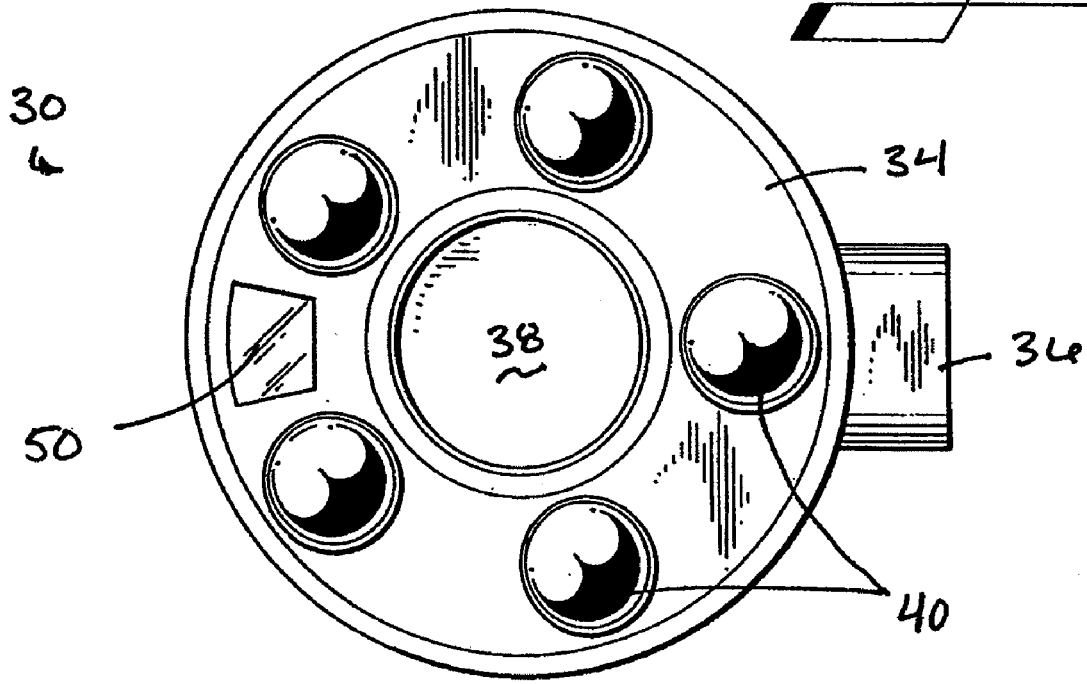
FIG. 4 is a bottom view of the housing in an embodiment of the present invention.
Figure 5:
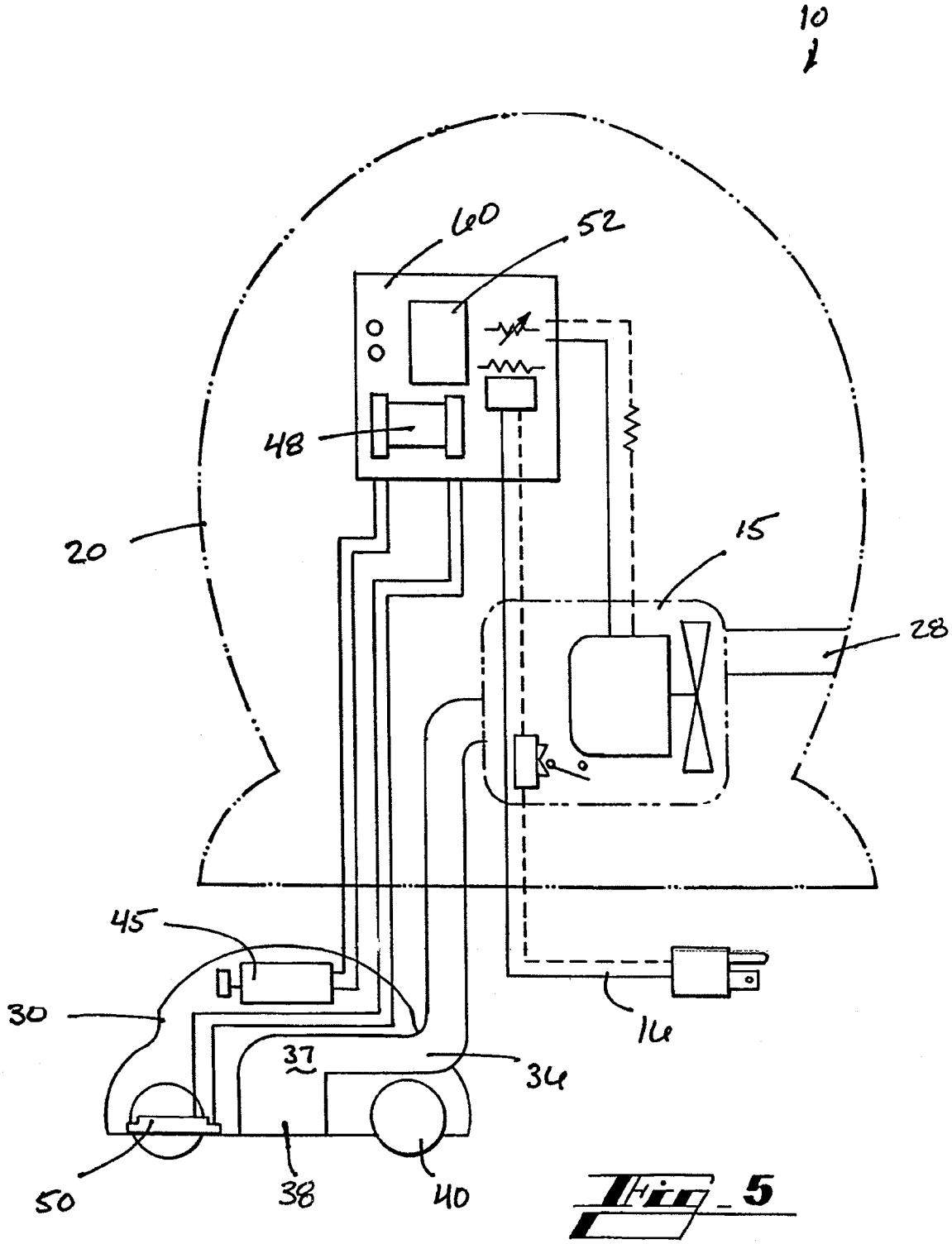
FIG. 5 is a schematic diagram of the cellulite treatment system in one embodiment of the present invention.
Figure 6:
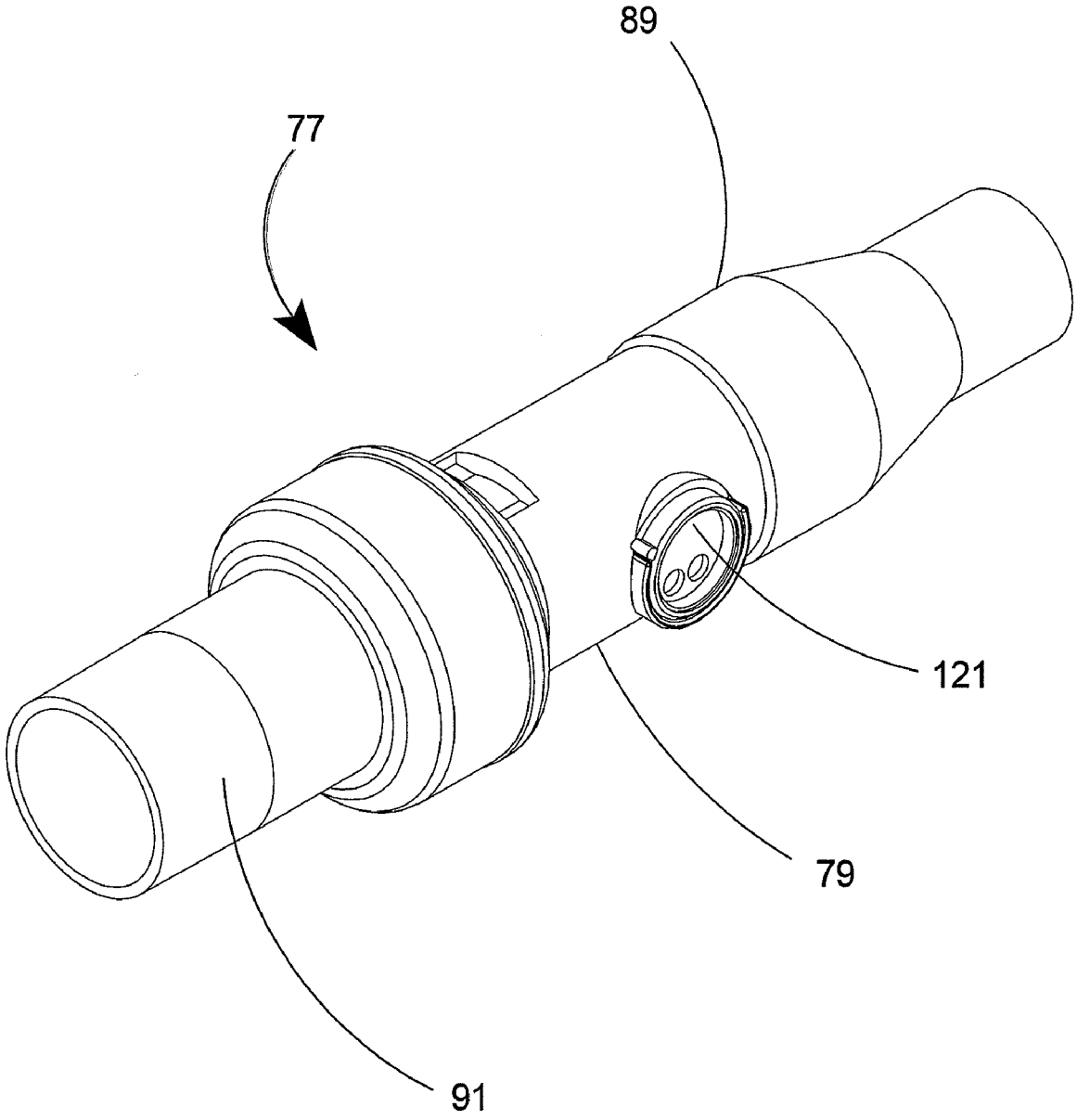
FIG. 6 is a perspective view of an adapter used to connect to a source of vacuum in one embodiment of the invention.
Figure 7:
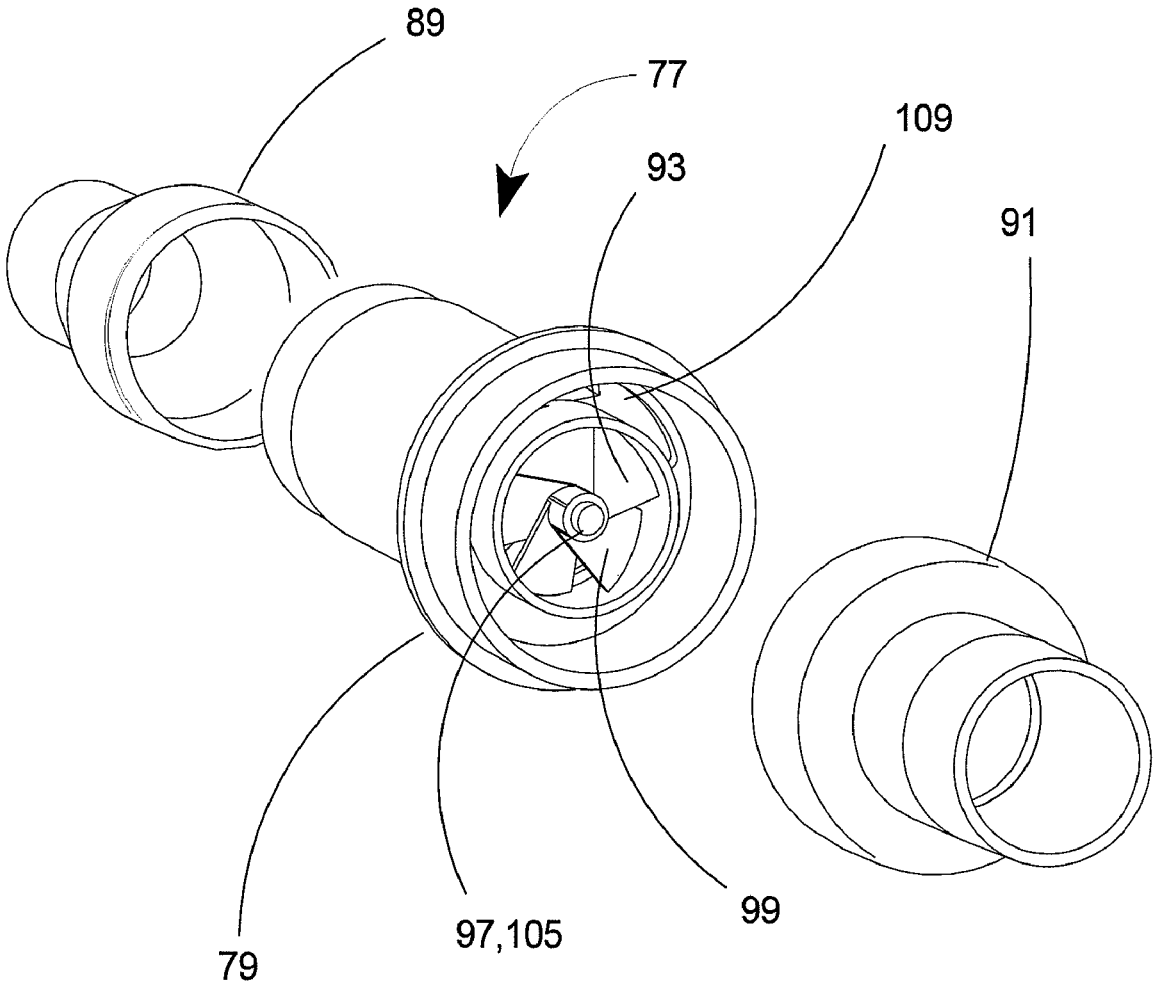
FIG. 7 is an exploded perspective view of the adapter of FIG. 6.
Figure 8:
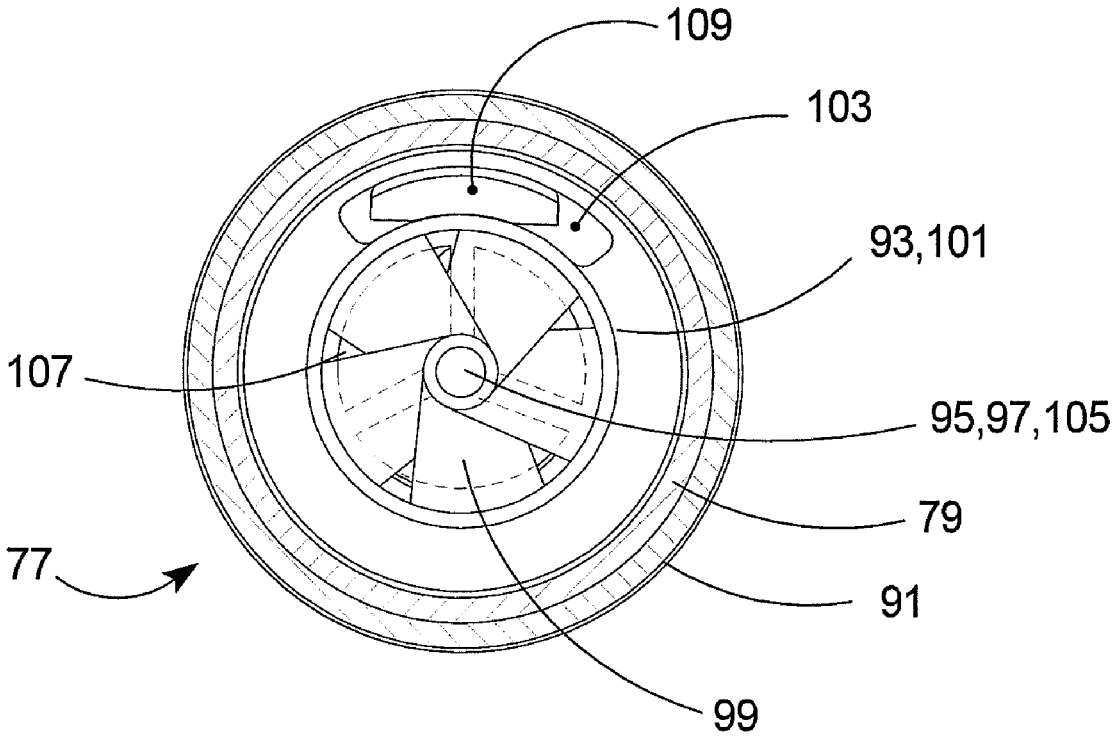
FIG. 8 is a transverse sectional view of the adapter.
Figure 9:
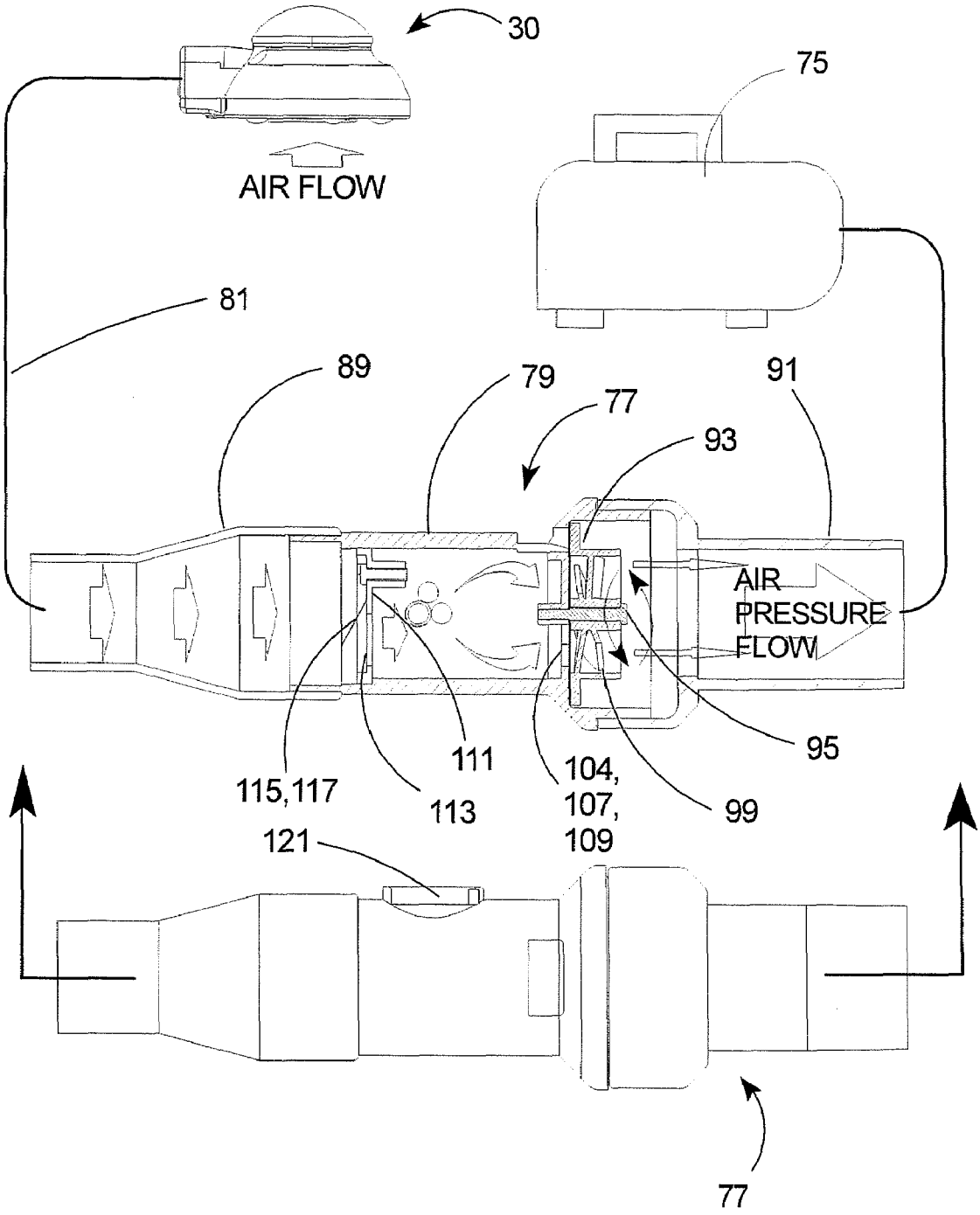
FIG. 9 is a longitudinal sectional view of the adapter.

With reference to FIGS. 3-5, the housing 30 includes a top portion 32 adapted for ease of manipulation by a user and a bottom portion 34. The housing 30 further includes a first opening 36 for communication with the vacuum source 15 and a second opening 38. The second opening 38 is in communication with the first opening 36 via an internal chamber 37 (FIG. 5) of the housing 30. The second opening 38 is located adjacent the bottom portion 34 of the housing for delivering negative pressure from the vacuum source 15 to the body. A plurality of roller balls 40 are disposed around the second opening 38 for delivering massage treatment. Therefore, the present invention provides a combination of massage treatment and negative pressure for the treatment of cellulite.

In the described embodiment, the top portion 32 of the housing 30 is substantially hemispheric and is sized to fit mainly within the palm of the user like a knob. A groove 33

(FIG. 3) may be provided on the top portion 32 to facilitate grasping and manipulation. In other embodiments, the top portion 32 may be of any suitable shape and may include a handle, a stap, or the like to assist in manipulation.

With reference to FIG. 4, in the described embodiment the second opening 38 of the housing 30 is substantially circular. The bottom portion 34 of the housing 30 includes a substantially flat surface that forms a ring around the second opening 38. The plurality of roller balls 40 are mounted within and held captive by cavities at the bottom portion 34 of the housing 30 and are arranged about the periphery of the second opening 38 such that the arrangement of roller balls 40 and the periphery of the second opening 38 are substantially concentric. It will be appreciated that the roller balls 40 may be incased in a suitable material to facilitate movement across the skin and aid in massage.

In the above embodiment, the housing 30 is constructed of molded plastic and includes rubber overmold on the top portion 32 to prevent slippage. The top portion 32 and the bottom portion 34 are joined together using screw assemblies. In other embodiments, the housing 30 may be constructed of ceramic or any suitable material and the top portion 32 and the bottom portion 34 may be configured to snap together or may be joined using an adhesive, staples, or the like. In one embodiment, the bottom portion 36 of the housing 30 may be constructed of a flexible material so as to conform to the anatomy during treatment.

In accordance with the present invention, the user grasps the housing 30, presses the bottom portion 36 of the housing 30 against the body, and moves the housing 30 across the skin to provide massage treatment and negative pressure to the skin. In use, the negative pressure provided by the vacuum source 15 pulls the skin into the second opening 38 of the housing 30. As the housing 30 is moved across the skin, the skin is massaged by the roller balls 40. Each of the roller balls 40 is configured to be freely rotatable. Thus, the housing 30 may be moved across the skin in any direction to provide cellulite treatment.

In one embodiment, a valve assembly may be provided adjacent the first opening 36 of the housing 30 to permit the user to adjust the intensity of the negative pressure delivered to the second opening 38. The valve assembly may include a c-ring valve located between the first opening 36 and the hose 18. In other embodiments, the valve assembly may include a ball valve, a slide valve, or the like.

Figure 10:
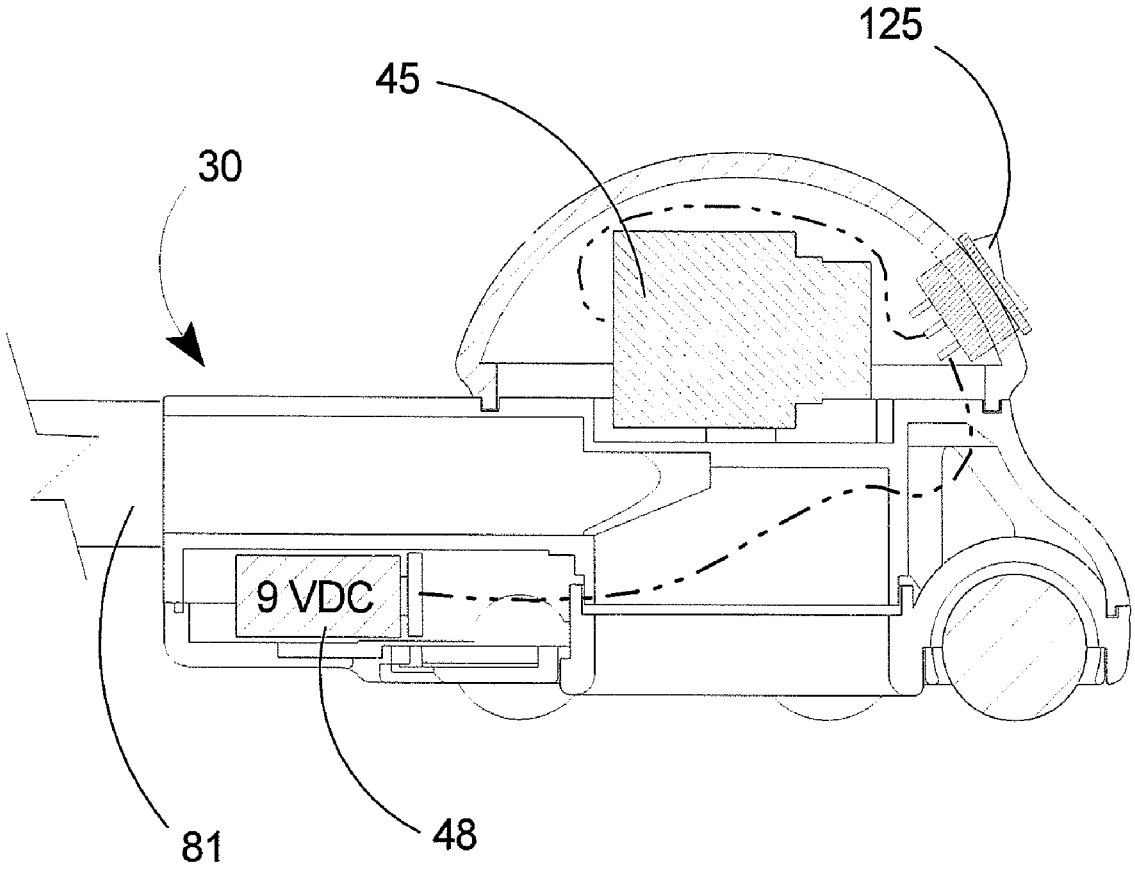
FIG. 10 is a sectional view of an embodiment of the hand held to be used with an alternative vacuum source.
Figure 11:
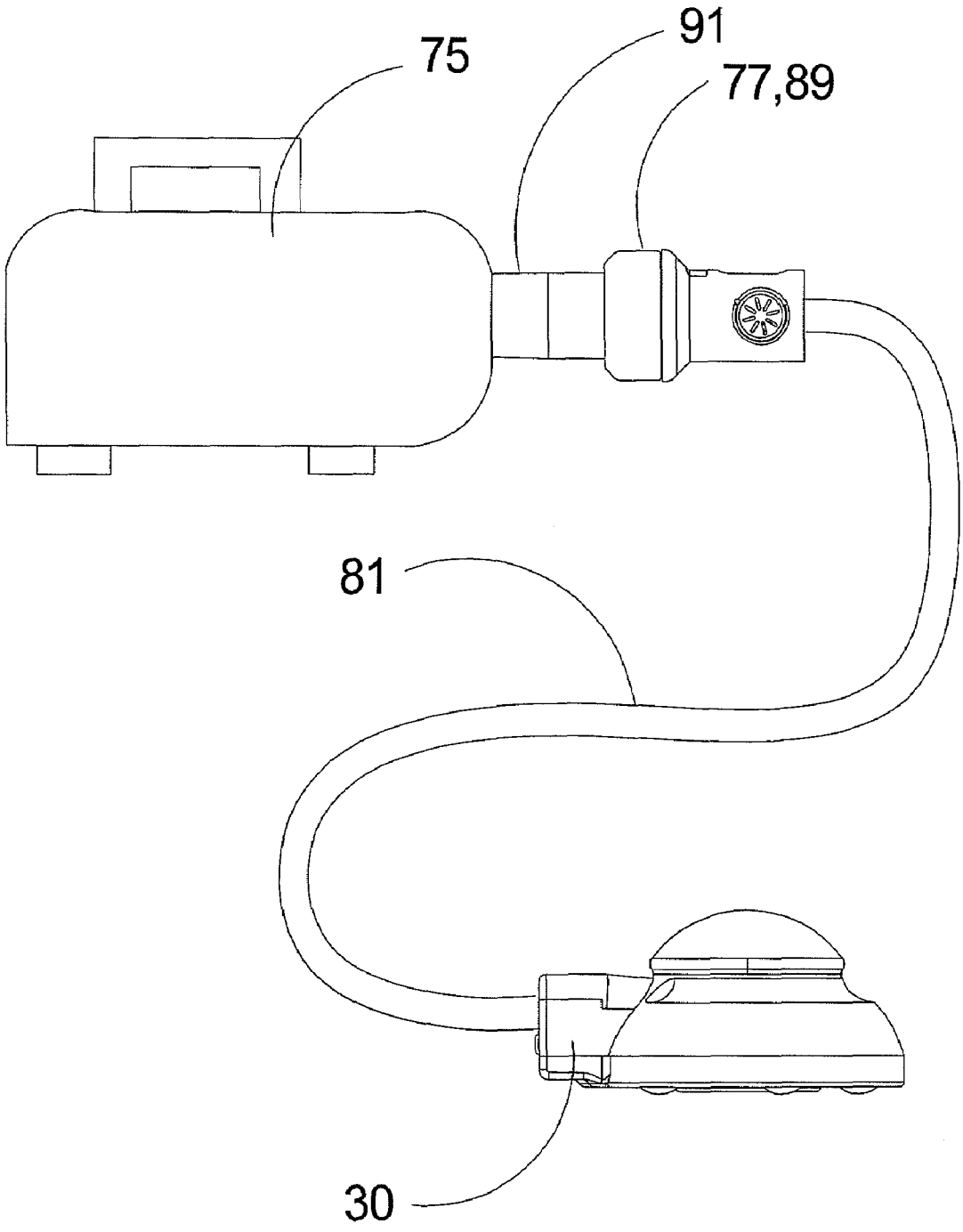
FIG. 11 is a schematic view of an embodiment showing the connection to an alternative vacuum source.

With reference to FIG. 5, in another embodiment, a vibration motor 45 is provided within the housing 30 to subject the housing 30 to mechanical vibration for facilitating the delivery of massage treatment. The vibration motor 45 may be connected to an auxiliary power source 48. By way of illustration for an embodiment wherein vacuum is derived from an auxiliary source, as shown in FIG. 10, vibration motor 45 is powered by an internal battery within housing 30.

With reference to FIGS. 4 and 5, in other embodiments, the present invention further includes a sensor 50 integrated into the housing 30 for monitoring movement of the housing across the skin. In the described embodiment, the sensor 50 is an optical sensor powered by the auxiliary power source 48 and mounted adjacent the bottom portion 34 of the housing and substantially between two roller balls 40. The sensor 50 is configured to detect movement of the housing 30 and to generate a corresponding output signal representative of a measure of movement of the housing 30. A programmable controller 52 receives the output signal from the sensor 50. When the output signal from the sensor 50 indicates a lack of or insufficient movement of the housing, the programmable controller 52 is configured to supply a reduction signal to the vacuum source 15 which causes the vacuum source 15 to substantially reduce or shut off vacuum. The reduction in suction serves as an indication to the user that the housing 30 should be kept in motion to prevent bruising or marking.

In other embodiments, the programmable controller 52 may be configured to activate an alarm when a lack of or insufficient movement of the housing is detected. Such an alarm may include activating an LED 53 located on the housing or, as shown in FIG. 1, on the portable container 20 to visibly prompt the user to resume movement of the housing. Other alarms may include activating an audio alarm or shutting off the vibration motor 45.

With reference to FIG. 5, in one embodiment a circuit board 60 may be provided within the portable container 20 for mounting the controller 52 and the auxiliary power source 48. The circuit board 60 may be mounted to the underside of the shelf 70 (FIG. 1). In certain embodiments, the hose 18 may be an electric hose and the vibration motor 45 and the sensor 50 may be connected to the circuit board 60 via the electric hose 18.

In accordance with the present invention, a portable system 10 is provided that includes a hand-held, easy to manipulate housing 30 that is suitable for an individual to use on his or her own body, and which may be moved across the skin in any direction for delivering massage treatment and negative pressure to the skin for treating cellulite.

More particularly, and with respect primarily to the embodiment including the modulator 77, the user attaches the modulator 77 to the "suction side" of the user's vacuum cleaner or the hose thereto. Hose 83, typically a ¾ to 1 inch but of any suitable diameter, is attached between modulator 77 and housing 30. The user then turns on the user supplied vacuum cleaner 75.

The pressure differential caused by the vacuum cleaner induces air flow through the modulator 77 and if the pressure differential is too high, reed valve 115 closes, preventing airflow into the hand held unit. The user then rotates adjustment knob 121 to a position that varies the effective throat area and reduces the differential pressure across the safety baffle 111 to an operational level, thereby allowing reed valve 115 to open such that air then flows through the modulator 77.

Air flows through the windows 107 of constriction baffle 104 causing the rotor to turn. The intermittent alignment of the rotor apertures 103 with the constriction baffle openings 109 modulates (pulses) the pressure differential which is felt at the opening 38 of the hand held unit. The user has the added option of powering the vibration motor driven motion at the hand held unit, this is accomplished by a single pole single throw rocker switch 125 located on the hand held unit body.

The resulting pressure pulses and the combined affect of vibration of the hand held unit and added variable multi axis rotation of the roller balls induces the stretching and smoothing of cellulite tissues and stimulated blood flow.

While this invention has been described with reference to preferred embodiments thereof, it is to be understood that variations and modifications can be affected within the spirit and scope of the invention as described herein and as described in the appended claims.

What we claim is:

1. An Apparatus for treating cellulite in the tissue of a user to be used with a vacuum source, comprising:

a housing having a bottom portion;

a first opening on the housing for fluid communication with the vacuum source;

a second opening on the housing in fluid communication with the first opening, wherein the second opening is located adjacent the bottom portion to induce air flow from beneath said bottom portion toward said vacuum source;

a plurality of roller balls captured in said bottom in a common plane and extending therefrom, said balls disposed around the second opening for engaging the tissue of the user in said common plane as said housing is urged across a surface of said tissue; and, means for modulating the differential pressure between said vacuum source and said second opening wherein said modulating means comprises a rotor mounted for rotation by air flow through said modulating means wherein said rotor includes a one or more air flow openings intermittently obscured during said rotation.

2. The apparatus of claim 1 further comprising a motor located within said housing for inducing mechanical vibration.

3. The apparatus of claim 2, wherein indicating insufficient movement of the housing includes activating an alarm.

4. The apparatus of claim 1 wherein the plurality of roller balls are mounted in cooperative cavities formed in said bottom portion of said housing and wherein each of said plurality of roller balls is freely rotatable.

5. The apparatus of claim 1 further comprising a sensor integrated into the housing for monitoring movement of the housing, said sensor generating an output signal representative of a predetermined increment of movement of the housing relative to said tissue, and further comprising a controller responsive to the output signal for indicating insufficient movement of the housing to substantially reduce or eliminate the pressure differential between said vacuum source and said second opening.

6. Apparatus for cellulite treatment, comprising:

a portable container;

a vacuum source located inside said portable container;

a housing sized to fit inside said portable container, wherein said housing has a bottom portion;

a first opening on the housing adapted to be removably affixed to the vacuum source;

a second opening on the housing in communication with the first opening, wherein the second opening is located adjacent the bottom portion for delivering negative pressure from the vacuum source;

a plurality of roller balls captured in said bottom in a common plane and extending therefrom, said balls disposed around the second opening for engaging the tissue of the user in said common plane as said housing is urged across a surface of said tissue; and, means for modulating the differential pressure between said vacuum source and said second opening wherein said modulating means comprises a rotor mounted for rotation by air flow through said modulating means wherein said rotor includes a one or more air flow openings intermittently obscured during said rotation.

7. The cellulite treatment system of claim 6 wherein the plurality of roller balls are mounted in cooperative cavities adjacent the bottom portion of the housing and wherein each of the plurality of roller balls is freely rotatable.

8. The cellulite treatment system of claim 6 further comprising a motor located within the housing for inducing mechanical vibration thereto.

9. The cellulite treatment system of claim 6 further comprising a sensor integrated into the housing for monitoring movement of the housing, said sensor generating an output signal representative of a predetermined increment of movement of the housing relative to said tissue, and further comprising a controller responsive to the output signal for indicating insufficient movement of the housing to substantially reduce or eliminate the pressure differential between said vacuum source and said second opening.

* * * * *